US010493651B1

(12) United States Patent
Farris et al.

(10) Patent No.: US 10,493,651 B1
(45) Date of Patent: Dec. 3, 2019

(54) WOODTURNING TOOL

(71) Applicant: Woodpeckers, LLC, Strongsville, OH (US)

(72) Inventors: Jeffery E. Farris, Medina, OH (US); Alex Krupa, Parma Heights, OH (US); Richard M. Hummel, Parma, OH (US)

(73) Assignee: Woodpeckers, LLC, Strongsville, OH (US)

( * ) Notice: Subject to any disclaimer, the term of this patent is extended or adjusted under 35 U.S.C. 154(b) by 0 days.

(21) Appl. No.: 16/179,108

(22) Filed: Nov. 2, 2018

(51) Int. Cl.
*B27G 15/00* (2006.01)
*B27C 7/06* (2006.01)

(52) U.S. Cl.
CPC ..... *B27G 15/00* (2013.01); *B27C 7/06* (2013.01)

(58) Field of Classification Search
CPC ..... B27G 15/00; B27G 17/00; B27G 17/025; B27C 7/00; B27C 7/06
See application file for complete search history.

(56) References Cited

U.S. PATENT DOCUMENTS 2,068,625 A * 1/1937 Burton ..... B23Q 35/102 142/38
3,014,509 A * 12/1961 Cederblad ..... B25D 3/00 142/56
4,063,577 A * 12/1977 Tennant ..... B27C 7/06 142/49
4,502,517 A * 3/1985 Larson ..... B27C 7/06 142/49
4,754,787 A * 7/1988 Smith ..... B27G 15/00 142/56
5,810,649 A * 9/1998 Oar ..... B24D 15/06 451/278
7,490,640 B2 * 2/2009 Hege ..... B27C 7/00 142/42
8,800,414 B2 * 8/2014 Martin ..... B23B 5/36 142/56
9,205,570 B2 12/2015 Perez et al.
2007/0151428 A1 * 7/2007 Hunter ..... B27G 15/00 82/1.11
2012/0006448 A1 * 1/2012 Batty ..... B27G 15/00 142/56
2012/0267008 A1 * 10/2012 Batty ..... B26B 5/00 142/56
2012/0291600 A1 * 11/2012 Perez ..... B27C 7/06 82/1.11

(Continued)

*Primary Examiner* — Willmon Fridie, Jr.
(74) *Attorney, Agent, or Firm* — Sand, Sebolt & Wernow Co., LPA

(57) ABSTRACT

A tool, system, and method for shaping a wooden workpiece. The system includes a lathe, a toolrest, and a woodturning tool for removing material from the workpiece. The tool includes a handle with a shaft extending longitudinally outwardly therefrom. A cutter is provided on an end of the shaft. The shaft includes a longitudinally-extending bottom surface and a longitudinally-extending side surface. The side surface extends laterally outwardly from the bottom surface and at an obtuse angle relative thereto. Each of the bottom and side surfaces is flat and is separately brought into contact with the toolrest on the lathe to steady the shaft and use the cutter on the workpiece. The orientation of the cutter is changed between a first position and second position depending on which of the bottom surface or side surface contacts the toolrest.

20 Claims, 7 Drawing Sheets

(56) References Cited

U.S. PATENT DOCUMENTS

| | | | | |
|---|---|---|---|---|
| 2014/0007979 | A1* | 1/2014 | Proctor | B23B 27/02 142/56 |
| 2018/0178404 | A1* | 6/2018 | Yu | B27G 15/00 |

* cited by examiner

WOODTURNING TOOL

BACKGROUND

Technical Field

The present disclosure relates to a woodworking tool. More particularly, the disclosure is directed to a woodturning tool. Specifically, the disclosure relates to a woodturning tool having a shaft with three longitudinally-extending and adjacent flat surfaces, wherein the flat surfaces include a bottom surface that is flanked by left and right side surfaces that are each oriented to the bottom surface at an obtuse angle. The shaft is rotated to selectively position one of these three flat surfaces on a toolrest on a lathe and to thereby select an orientation of a cutter at the end of the shaft relative to a wooden workpiece mounted on the lathe.

Background Information

Woodturning relates to the production of a wooden object on a lathe. A block of wood (or workpiece) is secured to the lathe and the lathe will rotate the workpiece about an axis of rotation. A wide variety of different hand-held woodturning tools have been developed to scrape and shave wood from a rotating workpiece in order to form a desired end product.

Typically, a woodturning tool will include a handle that has a steel shaft extending outwardly therefrom. A cutter will be provided at the end of the shaft. A craftsman will rest the shaft of the woodturning tool on a toolrest provided on the lathe and will bring the cutter at the tip of the woodturning tool into contact with the rotating workpiece. The cutter will tend to scrape or shave wood off the workpiece as the workpiece is rotated. The particular shape of the cutter will form a particular profile in the wood. The craftsman will adjust the angle of the shaft, and thereby of the cutter, and will vary the pressure of contact of the cutter with the rotating workpiece in order to form the desired shape of the end product.

Craftsmen will typically use a number of different woodturning tools while producing an end product. Each of the different tools will perform a different function. Over the past several years woodturning tools that utilize replaceable carbide inserts as cutters have become popular. The carbide inserts may have a round shape, a square shape, or a diamond shape, for example. Round shaped cutters may be utilized in tasks such as hollowing out the interior of a bowl, for example. If the woodturning tool, and thereby the round cutter is not held and manipulated in the correct fashion, then the hollowing process may not produce an aesthetically pleasing finish on the interior of a bowl, for example.

Some tool makers, such as Carter Products Company, Inc. of Grand Rapids, Mich., sell a round cutter woodturning tool that utilizes replaceable round carbide tips and has a flat region machined into the shaft of the woodturning tool. The flat region forms a back surface of the tool. During use, the craftsman will place the flat back surface onto the toolrest and this arrangement helps the craftsman to correctly position the cutter at a correct angle square onto the workpiece. However, hollowing workpieces with a cutter, it can be difficult to form a smooth interior surface on the hollowed region of the workpiece. This is because the shaft of the tool needs to be rotated to some degree during the cutting process. The rotation of the shaft can be reasonably difficult to perform in a fluid manner when trying to rotate a shaft that has a flat back surface into a different position. The shaft may therefore be provided with a radiused corners on either side of the flat region, i.e., the surfaces of the shaft immediately adjacent the longitudinal edges of the flat region are rounded.

SUMMARY

In one aspect, the present disclosure may provide a wordturning tool comprising a handle; a shaft extending outwardly from the handle, said shaft having a longitudinal axis; and a cutter provided on an end of the shaft a distance away from the handle; wherein the shaft includes a bottom surface and a side surface extending outwardly from the bottom surface and at an obtuse angle relative thereto; wherein each of the bottom surface and the side surface is flat and is adapted to be separately brought into contact with a toolrest on a lathe.

In another aspect, the present disclosure may provide a wordturning tool comprising a handle; a shaft extending outwardly from the handle, said shaft having a longitudinal axis; and a cutter provided on an end of the shaft a distance away from the handle; wherein the shaft includes a region having an exterior surface oriented at right angles to the longitudinal axis; wherein the exterior surface is adapted to be brought into contact with a top surface of a toolrest on a lathe; and wherein the region is a truncated-triangle in shape. The exterior surface includes a bottom surface, a left side surface extending outwardly from the bottom surface in a first direction, and a right side surface extending outwardly from the bottom surface in a second direction; wherein each of the left side surface and the right side surface is oriented at an obtuse angle relative to the bottom surface. The obtuse angle is about 135° each of the bottom surface, the left side surface, and the right side surface is flat.

In another aspect, the present disclosure may provide a system for shaping a workpiece comprising a lathe including a chuck adapted to retain a workpiece thereon; a toolrest provided on the lathe; and a woodturning tool adapted to remove material from the workpiece, wherein said woodturning tool comprises a handle; a shaft extending outwardly from the handle, said shaft having a longitudinal axis; and a cutter provided on an end of the shaft a distance away from the handle; wherein the shaft includes a bottom surface and a side surface that extend longitudinally along the shaft; and wherein the side surface extends laterally from the bottom surface and at an obtuse angle relative thereto; wherein the bottom surface and side surface are selectively brought into contact with a surface of the toolrest. The bottom surface and side surface form part of an exterior surface of the shaft. The side surface is a left side surface that extends outwardly from the bottom surface in a first direction; and the exterior surface of the shaft further includes a right side surface that extends outwardly from the bottom surface in a second direction and at a same obtuse angle relative to the bottom surface. The obtuse angle is about 135°. The shaft is a five-sided polygon in cross-section and includes five longitudinally extending surfaces that form an exterior surface of the shaft; and wherein the bottom surface and side surface comprise two sides of the five-sided polygon. Each of the bottom surface, the left side surface, and the right side surface is flat. The top surface of the toolrest is also flat.

In another aspect, the present disclosure may provide a method of shaping a wooden workpiece comprising securing a wooden workpiece to a rotatable member of a lathe; rotating the rotatable member about an axis; resting a bottom surface of a shaft of a woodturning tool on a top surface of a toolrest on the lathe, where the bottom surface is flat; bringing a cutter on the end of the shaft into contact with the wooden workpiece; removing wood from the wooden workpiece with the cutter, when the cutter is located in a first orientation; rotating the shaft of the woodturning tool to bring a side surface of the shaft into contact with the top surface of the toolrest, wherein side surface is flat and is oriented at an obtuse angle relative to the bottom surface; and removing wood from the wooden workpiece with the cutter, when the cutter is located in a second orientation. The step of removing of wood with the cutter when the cutter is in the first orientation includes producing a rough-cut surface in the workpiece. The step of removing of wood with the cutter when the cutter is in the second orientation includes producing a finished surface in the workpiece. The step of producing of the finished surface includes producing the finished surface with the cutter and without requiring additional sanding to produce the finished surface.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
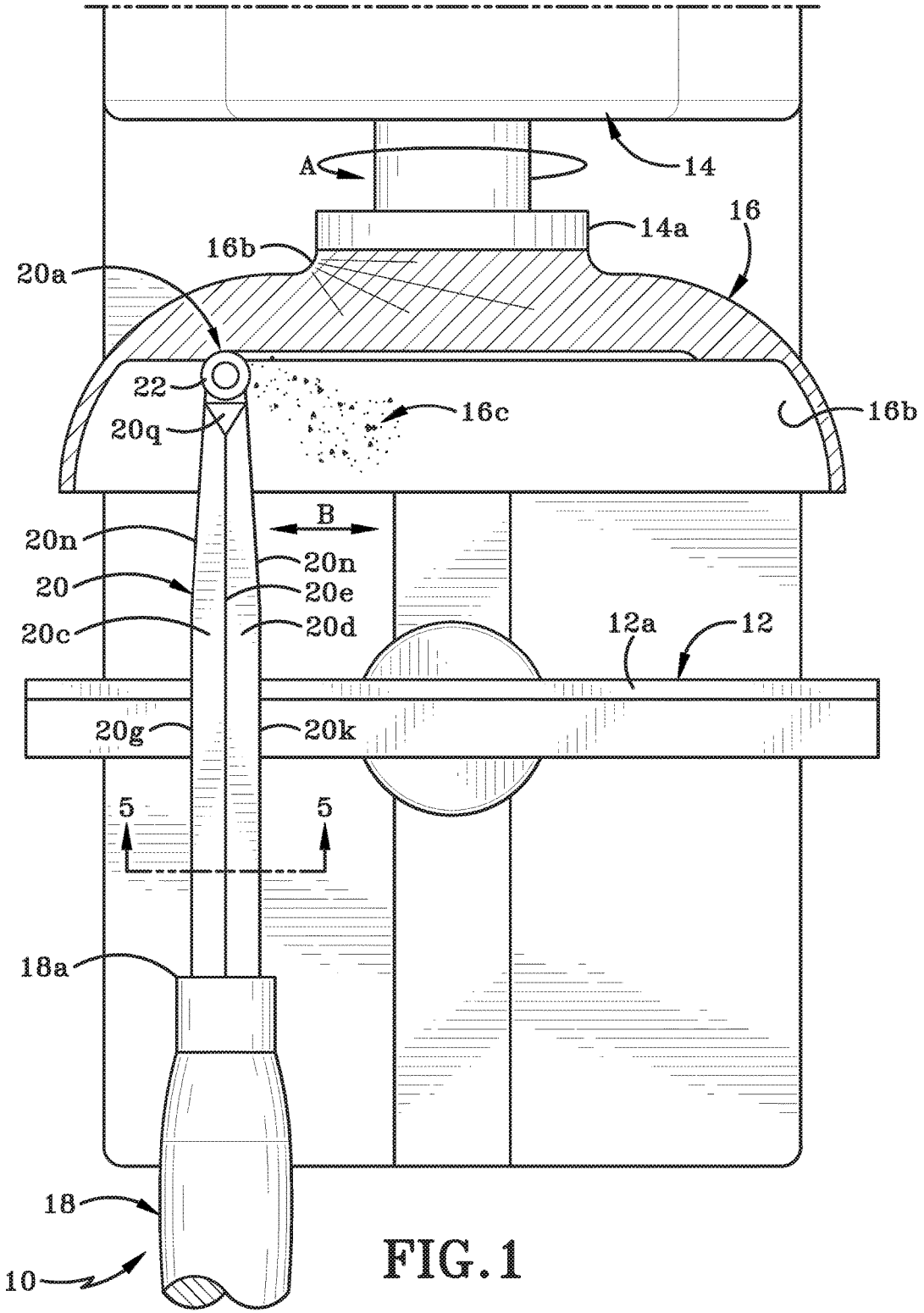
FIG. 1 is a partial top plan view of a woodturning tool in accordance with an aspect of the present disclosure, with the tool shown in a first position where the tool is being used to remove wood from a workpiece that is rotatably secured to a chuck of a lathe.

Referring to FIGS. 1-9, there is shown a woodturning tool in accordance with the present disclosure, generally indicated at 10. Tool 10 is shown in a first position in FIG. 1 resting on a portion of a toolrest 12 of a lathe, where a portion of the lathe is illustrated in the figure and is indicated by the reference number 14. Tool 10 is being utilized to remove wood from a workpiece 16. In particular, tool 10 is being utilized to hollow out an interior cavity 16*a* of a bowl (i.e., the workpiece 16). Workpiece 16 is attached to a chuck 14*a* of lathe 14 by way of a tenon 16*b* extending outwardly from a bottom end of workpiece 16. The chuck 14*a* is rotated, as indicated by arrow "A". FIG. 1 also shows tool 10 being moved in the direction of arrow "B" and wood shavings 16*c* being removed from workpiece 16.

Figure 2:
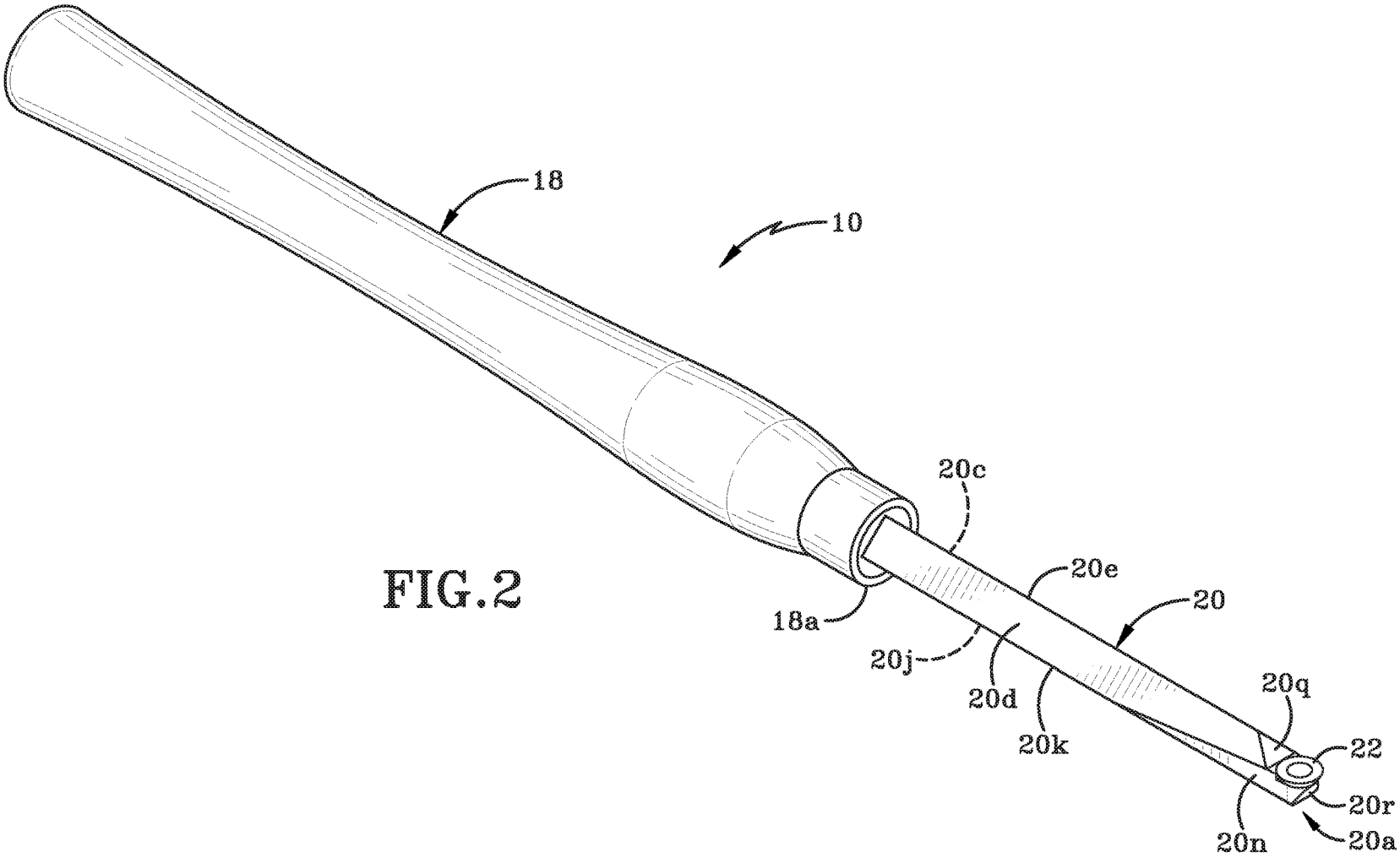
FIG. 2 is an isometric perspective top view of the woodturning tool shown on its own.
Figure 3:
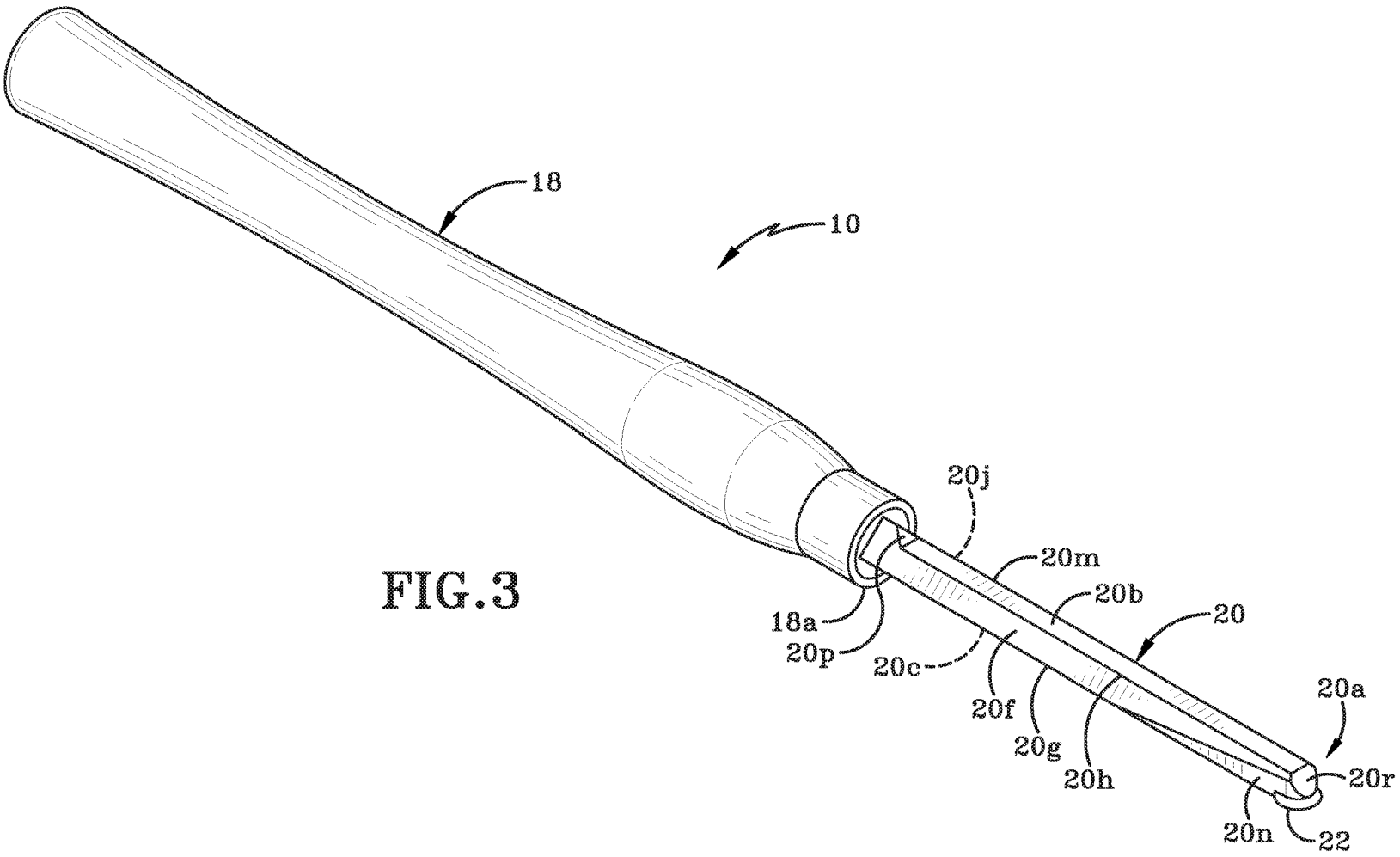
FIG. 3 is an isometric perspective bottom view of the woodturning tool shown on its own.
Figure 4:
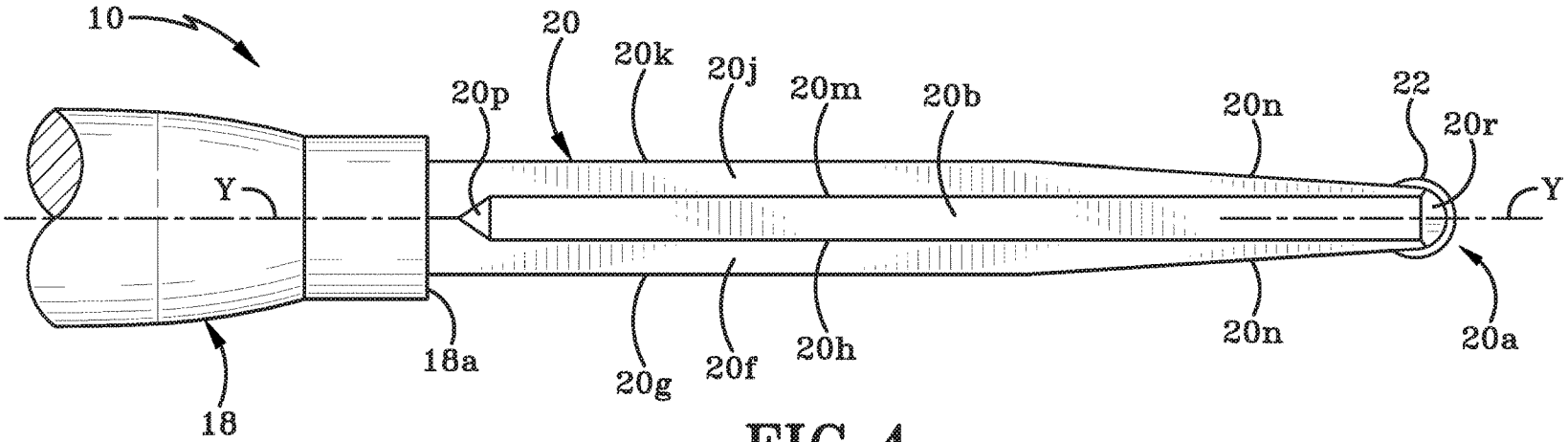
FIG. 4 is a partial bottom plan view of the woodturning tool.

FIGS. 2-4 show tool 10 in greater detail. Tool 10 includes a handle 18 that may be fabricated of wood or any other suitable material. Handle 18 may be ergonomically shaped and may be of any desired length and cross-sectional shape. A shaft 20 extends outwardly from a first end 18*a* of handle 18. Shaft 20 may have a first end 20*a* that is located a distance outwardly beyond first end 18*a* of handle 18. Shaft 20 may have a second end that is embedded some distance within an interior bore of handle 18. Tool 10 has a longitudinal axis "Y" (FIG. 4) that extends from first end 18*a* of handle 18 to first end 20*a* of shaft 20. The specific configuration of shaft 20 is the focus of this disclosure and will be discussed later herein.

A cutter 22 is provided at first end 20*a* of shaft 20. Cutter 22 may comprise a carbide insert that is detachably secured to first end 20*a*. The particular cutter 22 shown in the attached figures is a round cutter. It will be understood, however, that the cutter 22 may be of a different shape from what is illustrated herein. For example, the cutter 22 may be of a square shape, or a diamond shape, or a square shape with rounded corners, or any other shape. Cutter 22 may be secured to shaft 20 by way of a fastener. The round cutter 22 is particularly useful for hollowing out cavities in workpieces 16. Other shaped cutters that may be engaged with shaft 20 may be utilized in other woodturning processes.

In other instances, the cutter 22 may be formed integral with shaft 20 and may be shaped in any manner that permits the craftsman to shape workpiece 16 through removal of wood therefrom. In other words, the cutter or the first end of shaft 20 may be configured to perform any of typical cutting actions of other wood turning tools such as parting tools, spear scrapers, skew chisels, round nose scrapers, bowl gouges, spindle gouges, roughing gouges, nose scrapers, etc.

Shaft 20 may be fabricated from any suitable material, such as steel, for example. Shaft 20 is fabricated so that substantially the entire length thereof has a cross-section that is configured as a five-sided polygon. Firstly, shaft 20 may be fabricate to have a bottom surface 20*b* that is flat and extends from a region proximate first end 18*a* of handle 18 to a region proximate first end 20*a* of shaft 20. Bottom surface 20*b* is provided so that shaft 20 may be rested in a first position (i.e., first orientation) upon at least a top surface 12*a* of toolrest 12. The flat bottom surface 20*b* helps the craftsman to hold first end 20*a* and cutter 22 in a stable position relative to workpiece 16.

Shaft 20 further comprises a left top surface 20*c* and a right top surface 20*d*. Left and right top surfaces 20*c*, 20*d* extend longitudinally from first end 18*a* of shaft 18 towards first end 20*a* of shaft 20. Left and right top surfaces 20*c*, 20*d* meet along a longitudinally-extending apex 20*e*. Left and right top surfaces 20*c*, 20*d* may be oriented at angle of about 90° relative to each other.

Shaft 20 further comprises a left side surface 20*f* that originates proximate first end 18*a* and terminates proximate first end 20*a* and is located between left top surface 20*c* and bottom surface 20*b*. Left side surface 20*f* meets left top surface 20*c* along a longitudinally-extending apex 20*g* (FIG. 5) and meets bottom surface 20*b* along a longitudinally-extending apex 20*h*. Left side surface 20*f* may be oriented at an angle of about 90° relative to left top surface 20*c*. Left side surface 20*f* may be oriented at an angle of about 135° relative to bottom surface 20*b*.

Shaft 20 further comprises a right side surface 20*j* that originates proximate first end 18*a* and terminates proximate first end 20*a* and is located between right top surface 20*d* and bottom surface 20*b*. (Bottom surface 20*b* originates a distance inwardly from the first end 18*a* of handle 18 and terminates a distance inwardly from the cutter 22.

Right side surface 20*j* meets right top surface 20*d* along a longitudinally-extending apex 20*k* (FIG. 5) and meets bottom surface 20*b* along a longitudinally-extending apex 20*m*. Right side surface 20*j* may be oriented at an angle of about 90° relative to right top surface 20*d*. Right side surface 20*j* may be oriented at an angle of about 135° relative to bottom surface 20*b*.

As shown in FIG. 4, each of the left side surface 20*f* and the right side surface 20*f* may extend for substantially the entire length of the shaft 20 that extends outwardly beyond first end 18*a* of handle 18. Bottom surface 20*b* may terminate a distance away from first end 18*a* in a transition region 20*n*.

As shown in FIG. 2, a wedge-shaped region 20*n* may be provided proximate first end 20*a* of shaft and between each of the left and right top surfaces 20*c*, 30*d*, and bottom surface 20*b*. Region 20*n* may extend between lower portions of left and right top surfaces 20*c*, 20*d*, and bottom surface 20*b* and extend to first end 20*a*. Cutter 22 may be mounted on region 20*n* and an angled surface 20*r* (FIGS. 3 & 4) may extend downwardly from below cutter 22 to bottom surface 20*b*.

Figure 5:
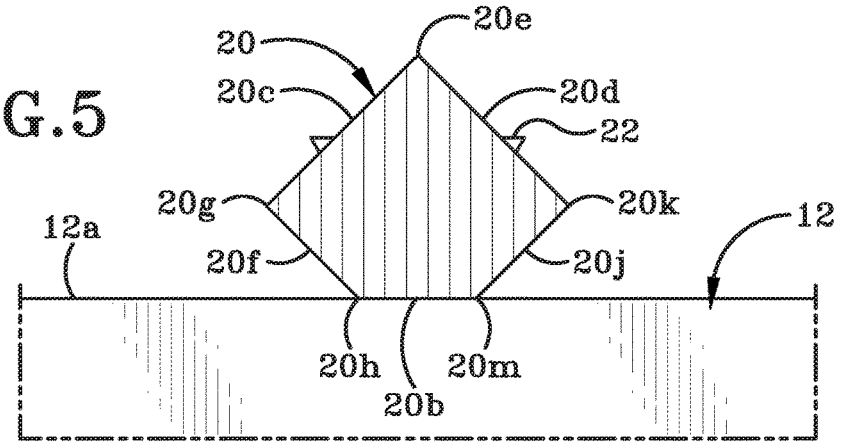
FIG. 5 is a partial cross-sectional view of the woodturning tool in the first position and shown in contact with the toolrest of the lathe, where the figure is taken along line 5-5 of FIG. 1.
Figure 7:
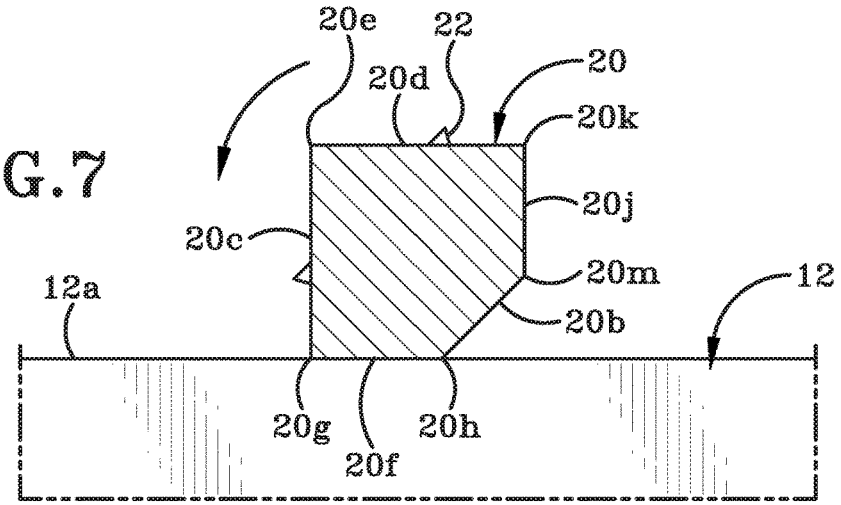
FIG. 7 is a partial cross-sectional view of the woodturning tool in the second position and shown in contact with the toolrest of the lathe, where the figure is taken along line 7-7 of FIG. 6.
Figure 8:
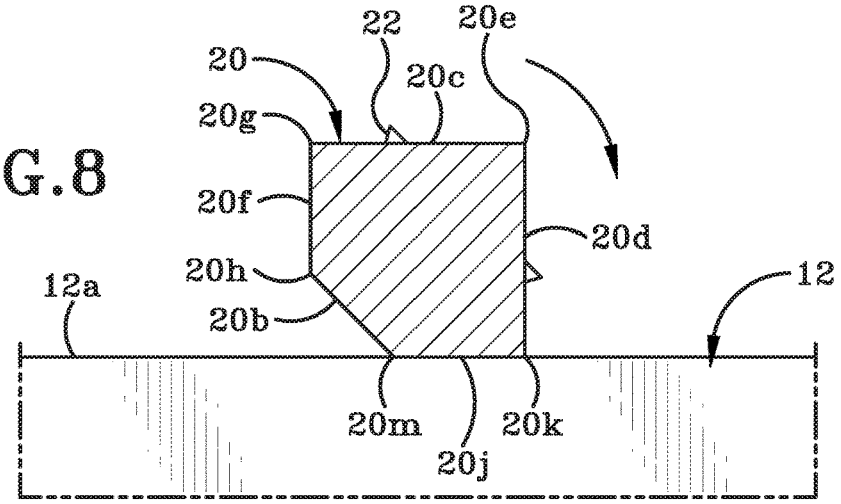
FIG. 8 is a partial cross-sectional view of the woodturning tool in a third position that is a mirror image of the second position shown in FIG. 7 and shows the tool in contact with the toolrest of the lathe when in the third position.

As shown in FIGS. 5, 7, and 8, the five-sided polygonal cross-sectional shape of the shaft 20 therefore comprises bottom surface 20*b*, left and right top surfaces 20*c*, 20*d*, and left and right side surfaces 20*f*, 20*j*; where the cross-section is oriented at right angles to the longitudinal axis "Y" of shaft 20.

While the angles between adjacent longitudinal surfaces of shaft 20 have been described above, it will be understood that shaft 20 may have the five-sided polygonal cross-sectional shape of a pentagon. In this instance, when the cross-sectional shape of a substantial length of shaft 20 is a pentagon, the angles between adjacent surfaces may be substantially equal i.e., in the order of around 108° relative to each other.

FIGS. 1 and 5 show tool 10 in a first position with bottom surface 20*b* resting on the top surface 12*a* of toolrest 12. Flat bottom surface 20*b* is able to be oriented parallel to the top surface 12*a* of toolrest 12 and substantially the entire width of bottom surface 20*b* from apex 20*h* to apex 20*m* is in abutting contact with top surface 12*a* of toolrest 12. As indicated earlier herein, this arrangement helps the craftsman to bring cutter 22 into contact with workpiece 16 in a controlled and stable manner. When tool 10 is used in the first position or first orientation, cutter 22 will cut away wood from workpiece 16 but the surface of the workpiece will be quite rough and will require sanding in order to make the interior surface bounding cavity 16*a* smooth.

Figure 6:
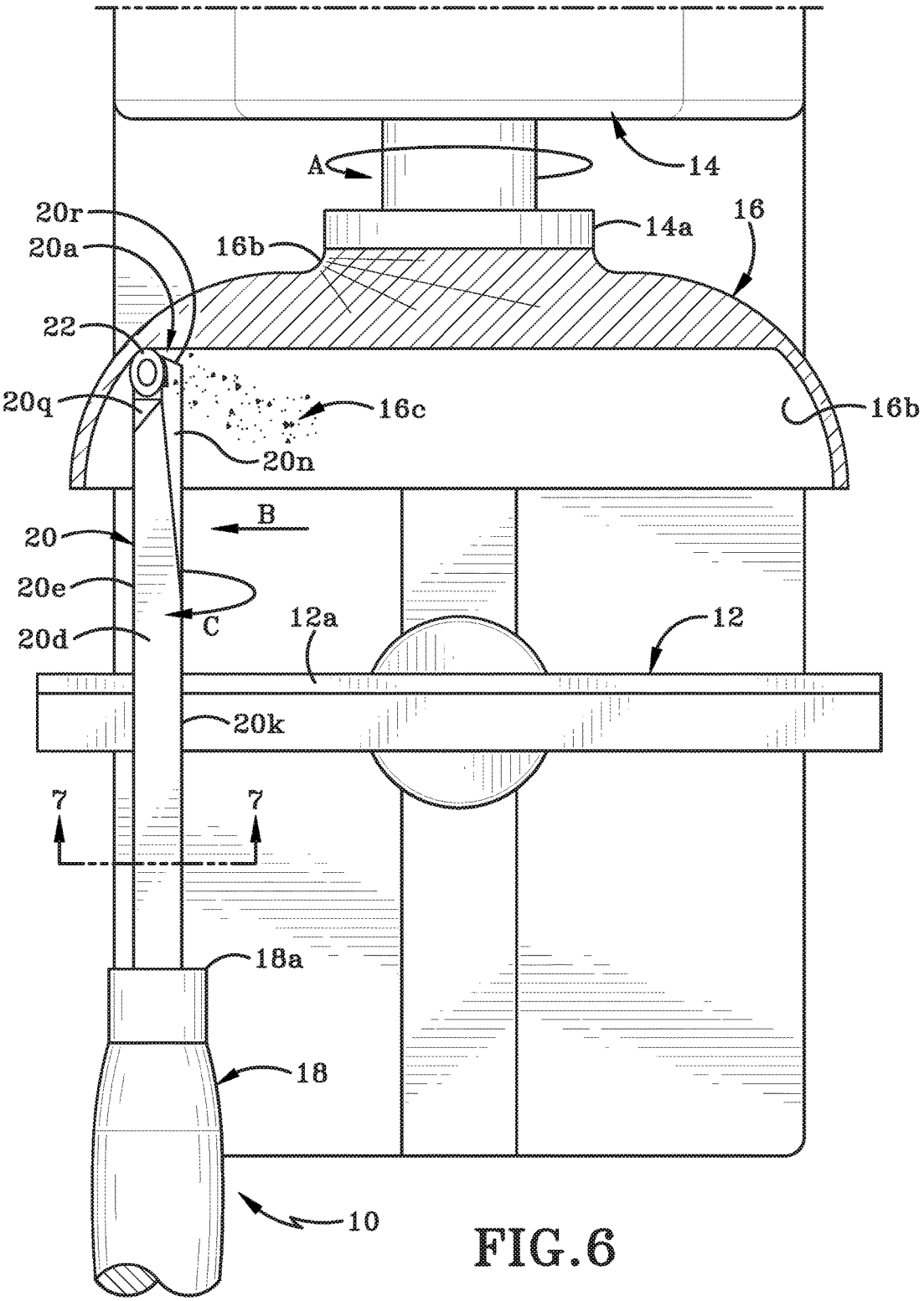
FIG. 6 partial top plan view of the woodturning tool in accordance shown in a second position where the tool is being used to remove wood from the workpiece that is rotatably secured to the chuck of the lathe.

If the craftsman desires to change the orientation of cutter 22 relative to workpiece 16 he or she can rotate tool 10 in the direction indicated by arrow "C" in FIG. 6. This rotation from the first position (FIGS. 1 and 5) to a second position (FIGS. 6 and 7) moves bottom surface 20*b* of shaft 20 from abutting contact with top surface 12*a* of toolrest 12 and brings left side surface 20*f* into contact with top surface 12*a* of toolrest 12. As can be seen from FIG. 7, substantially the entire width of left side surface 20*f* from apex 20*g* to apex 20*h* is oriented parallel to and in abutting contact with top surface 12*a* of toolrest 12. So, even when tool 10 is in this second position, cutter 22 may be brought into contact with workpiece 16 in a controlled and stable manner.

FIG. 8 shows tool 10 in a third position that is the mirror image of the second position. In order to move tool 10 from the first position to the third position, tool 10 is rotated in the opposite direction to arrow "C" in FIG. 6. When tool 10 is moved into the third position, bottom surface 20*b* of shaft 20 is moved out of contact with top surface 12*a* of toolrest 12 and right side surface 20*j* is brought into contact with top surface 12*a* of toolrest 12. As can be seen from FIG. 8, substantially the entire width of right side surface 20*j* from apex 20*e* to apex 20*k* is oriented parallel to and in abutting contact with top surface 12*a* of toolrest 12. So, even when tool 10 is in this third position, cutter 22 may be brought into contact with workpiece 16 in a controlled and stable manner.

When tool 10 is brought into contact with top surface 12*a* of toolrest in the rotated second or third position (FIG. 7 or 8), it can be seen that bottom surface 20*b* is oriented at an angle of about 45° relative to top surface 12*a*. When tool 10 is in this orientation, it has been found that cutter 22 is oriented in such a manner that it leaves interior surface bounding cavity 16*a* substantially smooth enough that no additional sanding thereof is required.

Figure 9:
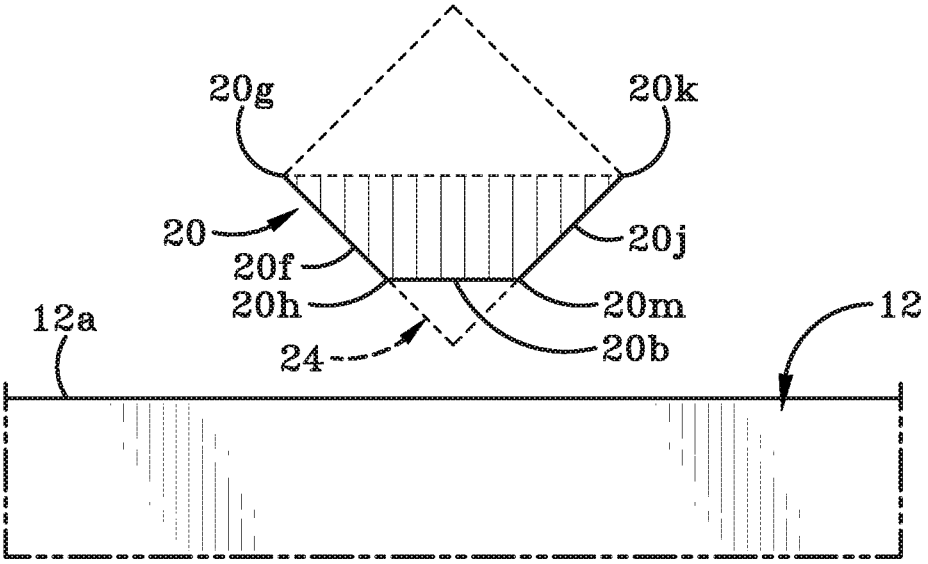
FIG. 9 is a partial cross-sectional view of the woodturning tool showing the region of the shaft that includes exterior surface is of a truncated-triangular shape and includes a left side surface, a bottom surface, a right side surface, and an imaginary line that extends from one apex to another; plus an additional region shown in phantom.

Shaft 20 includes a region having an exterior surface that is designed to be used to contact the top surface 12*a* of toolrest 12 of lathe 14 during use of tool 10. This exterior surface is oriented at right angles to longitudinal axis "Y". The entire exterior surface does not contact top surface 12*a* simultaneously. Instead, portions of the exterior surface of this region are selectively brought into contact with top surface 12*a* by rotating shaft 20. FIG. 9 shows that the region of the shaft 20 that includes exterior surface is of a truncated-triangular shape and includes left side surface 20*f*, bottom surface 20*b*, right side surface 20*j*, and an imaginary line that extends from apex 20*g* to apex 20*k*. The triangle in question could include the truncated-triangular shape defined above plus an additional region 24 that is shown in phantom in FIG. 9. The region 24 is, however, removed.

It will be understood that in other examples of a wood turning tool in accordance with the present design the left and right side top surfaces 20*c*, 20*d* may be replaced with a single surface that extends between apex 20*g* and apex 20*k*. The single surface may be straight or it may be curved (convexly or concavely) between apex 20*g* and apex 20*k*. Alternatively more than two surfaces may be provided in the place of left and right side top surfaces 20*c*, 20*d*.

Left top surface 20*c* is flat across substantially the entire width thereof from apex 20*g* to apex 20*e*. Right top surface 20*d* is flat across substantially the entire width thereof from apex 20*e* to apex 20*k*. While it is not disclosed herein that shaft 20 may be rotated to bring either the left top surface

20*c* or the right top surface 20*d* into contact with top surface 12*a* of toolrest 12, should a craftsman desire to do so, he or she may utilize tool 10 in this manner in order to further change the orientation of cutter 22.

The system disclosed herein may be used in the following way. In a first step, the craftsman will secure a wooden workpiece 16 to a rotatable member 14*a* of a lathe 14. Lathe 14 will be actuated and this in turn will cause rotation of the rotatable member 14*a* about an axis. Rotation in rotatable member 14*a* will cause rotation of workpiece 16 in a same direction and in unison with rotatable member 14*a*. The craftsman may selected to apply woodturning tools to an exterior side surface of workpiece 16 to produce an overall exterior shape thereof. Alternatively, and as illustrated in FIGS. 1 and 6 herein, the craftsman may select to apply a woodturning tool, such as tool 10 to remove wood from an end of the workpiece 16.

Tool 10 may be of a type that is hand-held and is entirely guided by the craftsman's hands during shaping of the workpiece 16. The type of shaping illustrated in the attached figures is the hollowing out of an interior cavity 16*a* in workpiece 16. The craftsman may rest a flat bottom surface 20*b* of a shaft 20 of tool 10 on a top surface 12*a* of a toolrest 12 on lathe 14. (Top surface 12*a* may be flat or rounded and may be horizontally oriented, curved, or angled.) The craftsman will bring a cutter 22 on the first end of shaft 20 into contact with the wooden workpiece 16; removing wood shavings 16*c* from the wooden workpiece 16 with the cutter 22. When bottom surface 20*b* of shaft 20 is rested on top surface 12*a* of toolrest 12, then the cutter 22 is located in a first orientation, shown in FIGS. 1 and 5. Because workpiece 10 is being rotated by lathe 14, wood will be shaved, scraped, cut or otherwise removed from workpiece 10 by cutter being held in the first orientation. The step of removing of wood with the cutter 22 when in the first orientation includes producing a rough-cut surface in the workpiece 16. This type of surface requires additional sanding with sandpaper in order to produce a finished surface.

However, if tool 10 is rotated so that shaft 20 is rotated about the longitudinal axis "Y" and one of the left side surface 20*f* or right side surface 20*j* is brought into contact with top surface 12*a* of tool 12, then the orientation of cutter 22 is changed from the first orientation shown in FIG. 1 to the second orientation shown in FIG. 6; if the left side surface 20*f* contacts top surface 12*a*; or is changed from the first orientation shown in FIG. 1 to a third orientation that is a mirror image of the orientation shown in FIG. 6 if the right side surface 20*j* contacts top surface 12*a*. Rotation of the workpiece 16 continues and the craftsman will bring cutter 22 into contact with the workpiece once again to remove wood from the wooden workpiece 16. The step of removing of wood with the cutter 22 when the cutter is in the second orientation (or third orientation) includes producing a finished surface in the workpiece 16. The step of producing of the finished surface includes producing the finished surface with only the cutter 22 and without requiring additional sanding with sandpaper in order to attain the desired finished surface. It will be understood that sandpaper may still be utilized if desired but it typically is not necessary to use sandpaper in order to produce the finished surface.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A woodturning tool comprising:

a handle;

a shaft extending outwardly from the handle, said shaft having a longitudinal axis; and a cutter provided on an end of the shaft a distance away from the handle;

wherein the shaft includes:

a bottom surface;

a side surface extending laterally outwardly from the bottom surface;

a top surface extending laterally outwardly from the side surface; and a generally triangular region interposed between the side surface and the top surface proximate the end of the shaft;

wherein each of the bottom surface, the side surface, the top surface, and the generally triangular surface are flat and are adapted to be separately brought into contact with a toolrest on a lathe.

2. A woodturning tool comprising:

a handle;

a shaft extending outwardly from the handle, said shaft having a longitudinal axis; and a cutter provided on an end of the shaft a distance away from the handle;

wherein the shaft includes a bottom surface and a side surface extending outwardly from the bottom surface and at an obtuse angle relative thereto; wherein each of the bottom surface and the side surface is flat and is adapted to be separately brought into contact with a toolrest on a lathe; wherein the bottom surface and side surface form part of a region of the shaft that has an exterior surface oriented at right angles to the longitudinal axis; wherein the exterior surface is adapted to be brought into contact with a top surface of a toolrest on a lathe; and wherein the region is a truncated-triangle in shape.

3. The woodturning tool defined in claim 2, wherein the exterior surface includes the bottom surface and the side surface is a left side surface extending outwardly from the bottom surface in a first direction, and the exterior surface further comprises a right side surface extending outwardly from the bottom surface in a second direction; wherein each of the left side surface and the right side surface is oriented at an obtuse angle relative to the bottom surface.

4. The woodturning tool defined in claim 3, wherein the obtuse angle is about 135°.

5. The woodturning tool defined in claim 3, wherein each of the bottom surface, the left side surface, and the right side surface is flat.

6. The woodturning tool defined in claim 3, wherein the left side surface and right side surface each originate proximate the handle and terminate proximate the cutter.

7. The woodturning tool defined in claim 6, wherein the bottom surface originates a distance inwardly from the handle and terminates a distance inwardly from the cutter.

8. The woodturning tool defined in claim 3, wherein the shaft is a five-sided polygon in cross-section; and further includes a left top surface and a right top surface; wherein the left top surface extends outwardly from the left side surface; and the right top surface extends outwardly from the right side surface; and the left top surface and right top surface meet along a longitudinally extending apex.

9. The woodturning tool defined in claim 8, wherein the left top surface is oriented at about 90° relative to the left side surface; the right top surface is oriented at about 90° to the right side surface; and the left top surface is oriented at about 90° relative to the right top surface.

10. The woodturning tool defined in claim 8, wherein each of the bottom surface, left side surface, right side surface, left top surface, and right top surface is flat.

11. A system for shaping a workpiece comprising:

a lathe including a chuck adapted to retain a workpiece thereon;

a toolrest provided on the lathe; and a woodturning tool adapted to remove material from the workpiece, wherein said woodturning tool comprises:

a handle;

a shaft extending outwardly from the handle, said shaft having a longitudinal axis; and a cutter provided on an end of the shaft a distance away from the handle; wherein the shaft includes a bottom surface, a side surface, and a top surface that extend longitudinally along the shaft from the handle to proximate the end of the shaft and are flat; and a transition surface that originates a distance longitudinally away from the handle and extends to proximate the end of the shaft; and wherein the side surface extends laterally between the bottom surface and the top surface and at an obtuse angle relative thereto; and the transition surface extends laterally between a portion of the top surface and a portion of the side surface; and wherein the bottom surface, top surface, side surface, and the transition surface are selectively individually brought into contact with a surface of the toolrest.

12. A system for shaping a workpiece comprising:

a lathe including a chuck adapted to retain a workpiece thereon;

a toolrest provided on the lathe; and a woodturning tool adapted to remove material from the workpiece, wherein said woodturning tool comprises:

a handle;

a shaft extending outwardly from the handle, said shaft having a longitudinal axis; and a cutter provided on an end of the shaft a distance away from the handle; wherein the shaft includes a bottom surface and a side surface that extend longitudinally along the shaft; and wherein the side surface extends laterally from the bottom surface and at an obtuse angle relative thereto; wherein the bottom surface and side surface are selectively brought into contact with a surface of the toolrest; wherein the bottom surface, and side surface form part of an exterior surface of the shaft; and wherein the side surface is a left side surface that extends outwardly from the bottom surface in a first direction; and wherein the exterior surface further includes a right side surface that extends outwardly from the bottom surface in a second direction and at a same obtuse angle relative to the bottom surface.

13. The system as defined in claim 12, wherein the obtuse angle is about 135°.

14. The system as defined in claim 12, wherein the shaft is a five-sided polygon in cross-section and includes five longitudinally extending surfaces that form an exterior surface of the shaft; and wherein the bottom surface and side surface comprise two sides of the five-sided polygon.

15. The system defined in claim 12, wherein each of the bottom surface, the left side surface, and the right side surface is flat.

16. The system defined in claim 12, wherein a top surface of the toolrest is flat.

17. A method of shaping a wooden workpiece comprising:

securing a wooden workpiece to a rotatable member of a lathe;

rotating the rotatable member about an axis;

providing a woodturning tool having a handle and a shaft; where the shaft includes a bottom surface, a top surface, and a side surface all extending from proximate the handle to proximate an end of the shaft; where the side surface is interposed between the top and bottom surfaces; and wherein the shaft further includes a transition surface interposed between a portion of the top surface and a portion of the side surface; wherein the transition surface originates a distance outwardly away from the handle and terminates proximate the end of the shaft; and wherein each of the bottom, top, side and transition surfaces are flat;

orienting a cutter on the end of the shaft in a first orientation by selectively resting one of the bottom, top, side, and transition surfaces of the shaft of the woodturning tool on a top surface of a toolrest on the lathe, bringing the cutter into contact with the wooden workpiece;

removing wood from the wooden workpiece with the cutter, when the cutter is in the first orientation;

rotating the shaft of the woodturning tool to position the cutter in a second orientation by placing another of the bottom, top, side, and transition surfaces of the shaft in contact with the top surface of the toolrest; and removing wood from the wooden workpiece with the cutter, when the cutter is located in a second orientation.

18. The method as defined in claim 17, wherein the removing of wood with the cutter when the cutter is in the first orientation includes producing a rough-cut surface in the workpiece.

19. The method as defined in claim 17, wherein the removing of wood with the cutter when the cutter is in the second orientation includes producing a finished surface in the workpiece.

20. The method as defined in claim 19, wherein the producing of the finished surface includes producing the finished surface with the cutter and without requiring additional sanding to produce the finished surface.

* * * * *